US010710130B2

(12) United States Patent
Yamashita

(10) Patent No.: US 10,710,130 B2
(45) Date of Patent: Jul. 14, 2020

(54) METHOD FOR PRODUCING H-SHAPED STEEL

(71) Applicant: NIPPON STEEL & SUMITOMO METAL CORPORATION, Tokyo (JP)

(72) Inventor: Hiroshi Yamashita, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 283 days.

(21) Appl. No.: 15/559,194

(22) PCT Filed: Mar. 10, 2016

(86) PCT No.: PCT/JP2016/057654
§ 371 (c)(1),
(2) Date: Sep. 18, 2017

(87) PCT Pub. No.: WO2016/148031
PCT Pub. Date: Sep. 22, 2016

(65) Prior Publication Data

US 2019/0084019 A1 Mar. 21, 2019

(30) Foreign Application Priority Data

Mar. 19, 2015 (JP) ..... 2015-056641

(51) Int. Cl.
*B21B 1/088* (2006.01)
*B21B 27/02* (2006.01)

(52) U.S. Cl.
CPC ..... *B21B 1/088* (2013.01); *B21B 27/02* (2013.01)

(58) Field of Classification Search
CPC ..... B21B 1/088; B21B 1/0883; B21B 1/0886; B21B 1/085; B21B 1/08; B21B 1/095;
(Continued)

(56) References Cited

FOREIGN PATENT DOCUMENTS

CN 1135381 A 11/1996
JP 57-193201 A 11/1982
(Continued)

OTHER PUBLICATIONS

Chinese Office Action and Search Report, dated Jul. 4, 2018, for corresponding Chinese Application No. 201680016812.2, with a partial English translation of the Office Action.
(Continued)

*Primary Examiner* — Adam J Eiseman
*Assistant Examiner* — Matthew Kresse
(74) *Attorney, Agent, or Firm* — Birch, Stewart, Kolasch & Birch, LLP

(57) ABSTRACT

The present invention relates to a method for producing H-shaped steel using a slab or the like having a rectangular cross-section as a material, for example. Provided is a method for producing H-shaped steel, the method including: a rough rolling step; an intermediate rolling step; and a finish rolling step. A slab material whose ratio of slab width to slab thickness is equal to or more than 6.0 and equal to or less than 7.7 is used as a material to be rolled. In a rolling mill a plurality of calibers having projections may be provided to shape the material to be rolled. The projections may have a height of 100 mm or more, and the tip of the projections may have an angle of equal to or more than 25° and equal to or less than 40°.

10 Claims, 9 Drawing Sheets

(58) Field of Classification Search
CPC ..... B21B 27/02; B21B 27/024; B21B 37/00; B21B 39/16
See application file for complete search history.

(56) References Cited

FOREIGN PATENT DOCUMENTS

| | | | |
|---|---|---|---|
| JP | 58-188501 | A | 11/1983 |
| JP | 1-186201 | A | 7/1989 |
| JP | 2-169103 | A | 6/1990 |
| JP | 7-164003 | A | 6/1995 |
| JP | 7-178404 | A | 7/1995 |
| JP | 2001-018002 | A | 1/2001 |
| JP | 2004-322105 | A | 11/2004 |
| JP | 2004-358541 | A | 12/2004 |
| JP | 2012-71346 | A | 4/2012 |

OTHER PUBLICATIONS

Extended European Search Report, dated Nov. 13, 2018, for corresponding European Application No. 16764861.7.
Chinese Office Action for corresponding Chinese Application No. 201680016812.2, dated Apr. 1, 2019, with partial English translation.
International Search Report (PCT/ISA/210) issued in PCT/JP2016/057654, dated Apr. 12, 2016.
Written Opinion (PCT/ISA/237) issued in PCT/JP2016/057654, dated Apr. 12, 2016.

METHOD FOR PRODUCING H-SHAPED STEEL

CROSS REFERENCE TO RELATED APPLICATIONS

This application claims the benefit of Japanese Priority Patent Application JP 2015-056641 filed Mar. 19, 2015, the entire contents of each of which are incorporated herein by reference.

The present invention relates to a method for producing H-shaped steel using a slab or the like having a rectangular cross-section as a material, for example.

TECHNICAL FIELD

Background Art

In the case where H-shaped steel is produced, a material, such as a slab or a bloom, extracted from a heating furnace is shaped into a raw blank (a material to be rolled with a so-called dog-bone shape) by a rough rolling mill (BD). Thicknesses of a web and flanges of the raw blank are subjected to reduction by an intermediate universal rolling mill, and moreover, flanges of a material to be rolled are subjected to width reduction and forging and shaping of end surfaces by an edger rolling mill close to the intermediate universal rolling mill. Then, an H-shaped steel product is shaped by a finishing universal rolling mill.

In such a method for producing H-shaped steel, a technology is known in which, in shaping a raw blank with a so-called dog-bone shape from a slab material having a rectangular cross-section, splits are created on slab end surfaces in a first caliber of a rough rolling step, the splits are then widened or made deeper and edging rolling is performed in a second caliber and subsequent calibers, and the splits on the slab end surfaces are erased in subsequent calibers. It is known that the depths of the splits expanded here sequentially become shallower or are approximately the same depth in the second caliber and subsequent calibers.

For example, the technology of Patent Literature 1 discloses a caliber configuration in which heights of projections of a plurality of calibers for creating splits in the rough rolling step (hereinafter also called wedge heights) are designed to be substantially the same height.

In addition, for example, the technology of Patent Literature 2 discloses a configuration in which a wedge height of a caliber for creating splits in the rough rolling step is highest in the first caliber and sequentially decreases in subsequent calibers.

CITATION LIST

Patent Literature

Patent Literature 1: JP 2062461B
Patent Literature 2: JP 2036476B

SUMMARY OF INVENTION

Technical Problem

In recent years, an increase in size of structures and the like has brought about demands for production of large-size H-shaped steel products. In particular, there have been demands for a product in which flanges, which greatly contribute to strength and rigidity of H-shaped steel, are made wider than conventional flanges. To produce an H-shaped steel product with widened flanges, it is necessary to shape a material to be rolled with a flange width larger than a conventional flange width from the stage of shaping in the rough rolling step.

However, there is a limit in widening of flanges in the technologies disclosed in Patent Literatures 1 and 2, for example, in which splits are created on end surfaces of a material such as a slab (slab end surfaces) and the end surfaces are subjected to edging, and the spread is utilized for rough rolling. That is, in order to widen flanges, conventional rough rolling methods use technologies such as wedge designing (designing of a split angle), reduction adjustment, and lubrication adjustment to improve spread, but none of the methods greatly contributes to a flange width; thus, it is known that the rate of spread, which indicates the ratio of a flange spread amount with respect to an edging amount, is approximately 0.8 even under a condition in which efficiency at the initial stage of edging is the highest, decreases as edging is repeated in the same caliber, and finally becomes approximately 0.5. It may also be possible to increase the size of the material (e.g., slab) itself to increase the edging amount, but product flanges are not sufficiently widened because there are device limits in equipment scale and an amount of reduction of rough rolling mills.

In view of such circumstances, studies have been made on employing a caliber configuration in which a wedge height is made larger to make the depth of the splits deeper than a conventional depth, for example. In such a case, however, larger wedge heights lead to left-right ununiformity in cross-sectional area of flange portions, and there is a possibility that material-passing defects occur and sufficient dimensional accuracy is not secured.

In view of the circumstances, an object of the present invention is to provide a method for producing H-shaped steel, the method enabling an improvement in material-passing property and an improvement in dimensional accuracy in the following manner: in producing H-shaped steel, when splits are created on end surfaces of a material (e.g., slab) by using projections with acute-angle tip shapes (hereinafter also called wedge portions), and flange portions formed by the splits are sequentially bent in a plurality of calibers, a wedge-portion height of each caliber is set to a height satisfying a predetermined condition.

Solution to Problem

According to the present invention in order to achieve the above-mentioned object, there is provided a method for producing H-shaped steel, the method including: a rough rolling step; an intermediate rolling step; and a finish rolling step. A slab material whose slab width/slab thickness is equal to or more than 6.0 and equal to or less than 7.7 is used as a material to be rolled. In a rolling mill that performs the rough rolling step, a plurality of calibers to shape the material to be rolled are engraved, the number of the plurality of calibers being four or more. Shaping of one or a plurality of passes is performed on the material to be rolled in the plurality of calibers. In a first caliber and a second caliber among the plurality of calibers, projections to create splits vertically with respect to a width direction of the material to be rolled are formed. The projections formed in the first caliber are designed to have a height of 100 mm or more, and the projections formed in the first caliber and the second caliber have a tip angle of 40° or less.

The slab material may have a slab width of 1800 mm or more and a slab thickness of 300 mm or more at a start of shaping in the first caliber.

The slab material may have a slab width of 1200 mm or more and a slab thickness of 250 mm or more at a start of shaping in the first caliber.

The projections formed in the first caliber and the second caliber may have a tip angle of equal to or more than 25° and equal to or less than 35°.

In the second caliber and subsequent calibers among the plurality of calibers, reduction may be performed in a state where end surfaces of the material to be rolled are in contact with caliber peripheral surfaces in shaping of at least one pass. In a third caliber and subsequent calibers among the plurality of calibers, a step of sequentially bending divided parts formed by the splits may be performed.

In the first caliber, a relief portion extending in a direction of being distanced from the material to be rolled in shaping may be formed at a material-to-be-rolled entry side of a side-wall portion that is adjacent to a side surface of the material to be rolled. The relief portion may have a curved shape in which an inner surface of the first caliber is more distanced from the material to be rolled as becoming closer to the material-to-be-rolled entry side in the side-wall portion. A curvature radius R of the curved shape may be 400 mm or less.

Advantageous Effects of Invention

According to the present invention, it is possible to improve material-passing property and improve dimensional accuracy in the following manner: in producing H-shaped steel, when splits are created on end surfaces of a material (e.g., slab) by using projections with acute-angle tip shapes (hereinafter also called wedge portions), and flange portions formed by the splits are sequentially bent in a plurality of calibers, a wedge-portion height of each caliber is set to a height satisfying a predetermined condition.

REFERENCE SIGNS LIST

Figure 1:
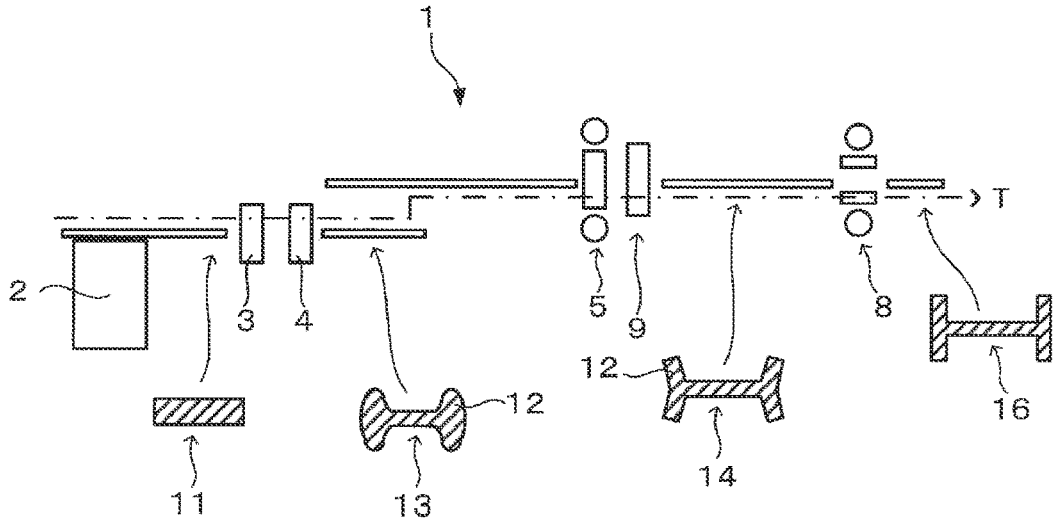
FIG. 1 is a schematic explanatory diagram for a production line of H-shaped steel.

1 rolling equipment
2 heating furnace
3 sizing mill
4 rough rolling mill
5 intermediate universal rolling mill
8 finishing universal rolling mill
9 edger rolling mill
11 slab
12 flange-corresponding portion
13 H-shaped raw blank
14 intermediate material
16 H-shaped steel product
20 upper caliber roll (first caliber)
21 lower caliber roll (first caliber)
25, 26 projection (first caliber)
28, 29 split (first caliber)
30 upper caliber roll (second caliber)
31 lower caliber roll (second caliber)
35, 36 projection (second caliber)
38, 39 split (second caliber)
40 upper caliber roll (third caliber)
41 lower caliber roll (third caliber)
45, 46 projection (third caliber)
48, 49 split (third caliber)
50 upper caliber roll (fourth caliber)
51 lower caliber roll (fourth caliber)
55, 56 projection (fourth caliber)
58, 59 split (fourth caliber)
80 flange portion
100 side-wall portion
102 overfill portion
110 relief portion
K1 first caliber
K2 second caliber
K3 third caliber
K4 fourth caliber
T production line
A material to be rolled

DESCRIPTION OF EMBODIMENTS

Hereinafter, (an) embodiment(s) of the present invention will be described with reference to the drawings. In this specification and the appended drawings, structural elements that have substantially the same function and structure are denoted with the same reference numerals, and repeated explanation of these structural elements is omitted.

FIG. 1 is an explanatory diagram for a production line T of H-shaped steel including rolling equipment 1 according to the present embodiment. As illustrated in FIG. 1, a heating furnace 2, a sizing mill 3, a rough rolling mill 4, an intermediate universal rolling mill 5, and a finishing universal rolling mill 8 are arranged in order from the upstream side in the production line T. In addition, an edger rolling mill 9 is provided close to the intermediate universal rolling mill 5. In the description below, steel materials in the production line T are collectively referred to as a "material to be rolled A" for description, and the shape thereof is illustrated with broken lines and oblique lines as appropriate in each drawing in some cases.

As illustrated in FIG. 1, in the production line T, the material to be rolled A, such as a slab 11, extracted from the heating furnace 2 is roughly rolled in the sizing mill 3 and the rough rolling mill 4, and then is subjected to intermediate rolling in the intermediate universal rolling mill 5. In this intermediate rolling, reduction is performed on end portions (flange-corresponding portions 12) of the material to be rolled, for example, by the edger rolling mill 9 as necessary. In a normal case, approximately four to six calibers in total are engraved on rolls of the sizing mill 3 and the rough rolling mill 4, and an H-shaped raw blank 13 is shaped through reverse rolling of a plurality of passes for each caliber by way of these calibers. Reverse rolling of a plurality of passes is performed similarly on the H-shaped raw blank 13 using a rolling mill train composed of two rolling mills of the intermediate universal rolling mill 5 and the edger rolling mill 9; thus, an intermediate material 14 is shaped. The intermediate material 14 is finish-rolled into a product shape in the finishing universal rolling mill 8, so that an H-shaped steel product 16 is produced.

Next, description will be given on configurations and shapes of calibers that are engraved in the sizing mill 3 and the rough rolling mill 4 illustrated in FIG. 1, with reference to drawings. Normally, the rough rolling mill 4 is further provided with, in addition to first to fourth calibers described below, a caliber for making the material to be rolled A that has been shaped in these calibers into the H-shaped raw blank 13 with a so-called dog-bone shape; this caliber is a conventionally known caliber and therefore illustration and description thereof are omitted in this specification. The heating furnace 2, the intermediate universal rolling mill 5, the finishing universal rolling mill 8, the edger rolling mill 9, and the like in the production line T are general devices conventionally used in production of H-shaped steel, and their device configurations and the like are known; thus, description of these devices is omitted in this specification.

FIGS. 2 to 5 are schematic explanatory diagrams for calibers that are engraved in the sizing mill 3 and the rough rolling mill 4, which perform a rough rolling step. Here, first to fourth calibers to be described may all be engraved in the sizing mill 3, for example, or four calibers of the first to fourth calibers may be engraved separately in the sizing mill 3 and the rough rolling mill 4. That is, the first to fourth calibers may be engraved across both the sizing mill 3 and the rough rolling mill 4, or may be engraved in either one of the rolling mills. In a rough rolling step in normal production of H-shaped steel, shaping in one or a plurality of passes is performed in each caliber.

In the present embodiment, a case where four calibers are engraved is described as an example, but the number of calibers is not necessarily four, and there may be a plurality of calibers, the number of the plurality of calibers being four or more. That is, any caliber configuration suitable for shaping the H-shaped raw blank 13 may be employed. Note that FIGS. 2 to 5 illustrate, with broken lines, the schematic final-pass shape of the material to be rolled A in shaping in each caliber.

Figure 2:
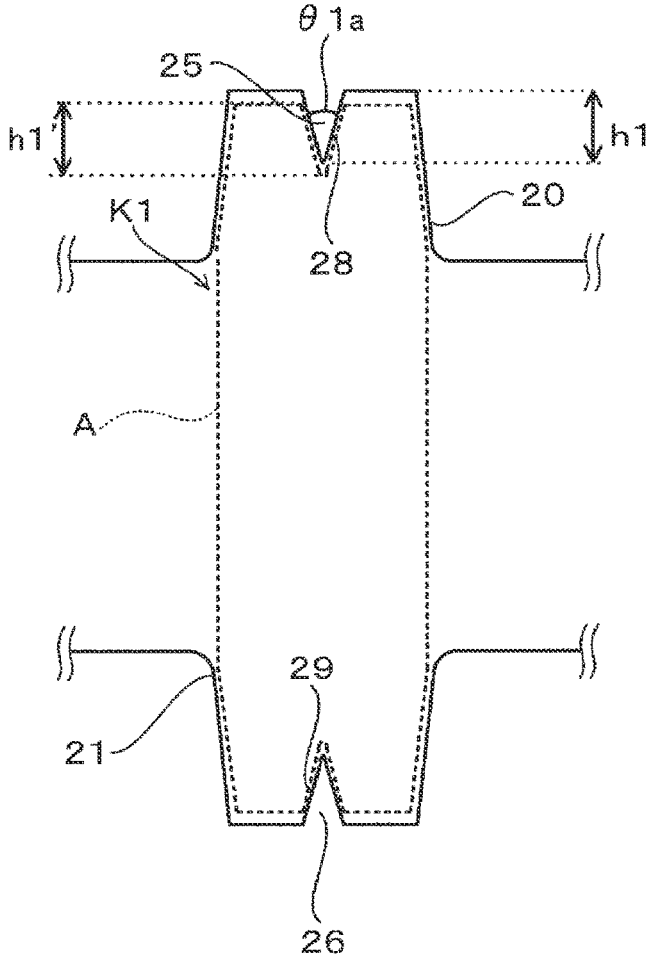
FIG. 2 is a schematic explanatory diagram of a first caliber.

FIG. 2 is a schematic explanatory diagram of a first caliber K1. The first caliber K1 is engraved on a pair of horizontal rolls, an upper caliber roll 20 and a lower caliber roll 21, and the material to be rolled A is subjected to reduction and shaping in a roll gap between the upper caliber roll 20 and the lower caliber roll 21. On a peripheral surface of the upper caliber roll 20 (i.e., a top surface of the first caliber K1), a projection 25 protruding toward the inside of the caliber is formed. Furthermore, on a peripheral surface of the lower caliber roll 21 (i.e., a bottom surface of the first caliber K1), a projection 26 protruding toward the inside of the caliber is formed. These projections 25 and 26 have tapered shapes, and dimensions, such as protrusion length, are configured to be equal between the projections 25 and 26. The height (protrusion length) of the projections 25 and 26 is denoted by h1, and a tip-portion angle thereof is denoted by θ1*a* (hereinafter also referred to as a wedge angle θ1*a*).

The height h1 of the projections 25 and 26 is a value satisfying a predetermined condition; specifically, in the case where slab dimensions of a material are equal to or more than a predetermined size, for example, the height h1 of the projections 25 and 26 needs to be set to 100 mm or more. The reason why the height h1 of the projections 25 and 26 needs to be a value satisfying a predetermined condition will be described later with reference to FIGS. 6 to 9.

In this first caliber K1, the projections 25 and 26 are pressed against upper and lower end portions of the material to be rolled A (slab end surfaces) to form splits 28 and 29. Here, the tip-portion angle θ1*a* of the projections 25 and 26 is preferably equal to or more than 25° and equal to or less than 40°, for example, further preferably equal to or more than 25° and equal to or less than 35°.

When the wedge angle is large, a wedge inclination angle is enlarged, which makes pressing force in the up-and-down direction due to friction force easily act on the material to be rolled A; thus, a reduction in cross-sectional area occurs at inner surface portions of flange-corresponding portions in split formation, causing a decrease in efficiency in generating flanges particularly in shaping using the second caliber K2 and subsequent calibers.

According to the above reason, the tip-portion angle θ1*a* of the projections 25 and 26 is preferably equal to or more than 25° and equal to or less than 40°. Similarly, a wedge angle θ1*b* described below is preferably equal to or more than 25° and equal to or less than 40°. From the viewpoint of achieving high efficiency in generating flanges, it is further preferable to set these wedge angles θ1*a* and θ1*b* to equal to or more than 25° and equal to or less than 35°.

Here, a caliber width of the first caliber K1 is preferably substantially equal to a thickness of the material to be rolled A (i.e., a slab thickness). Specifically, when the width of the caliber at the tip portions of the projections 25 and 26 formed in the first caliber K1 is set to be the same as the slab thickness, the property of left-right centering of the material to be rolled A is ensured suitably. Moreover, it is preferable to employ this configuration of caliber dimensions so that, in shaping using the first caliber K1, the projections 25 and 26 and part of side surfaces (side walls) of the caliber be in contact with the material to be rolled A at the upper and lower end portions of the material to be rolled A (the slab end surfaces), and active reduction not be performed by the top surface and the bottom surface of the first caliber K1 on slab upper and lower end portions, which are divided into four elements (parts) by the splits 28 and 29, as illustrated in FIG. 2. This is because reduction by the top surface and the bottom surface of the caliber causes stretch of the material to be rolled A in the longitudinal direction, which decreases efficiency in generating flanges (flange portions 80 described later). That is, in the first caliber K1, an amount of reduction at the projections 25 and 26 (amount of reduction ΔT at wedge tips) when the projections 25 and 26 are pressed against upper and lower end portions of the material to be rolled A (slab end surfaces) to form the splits 28 and 29 is set to be sufficiently larger than an amount of reduction at the slab upper and lower end portions (amount of reduction ΔE at slab end surfaces); thus, the splits 28 and 29 are formed.

Figure 3:
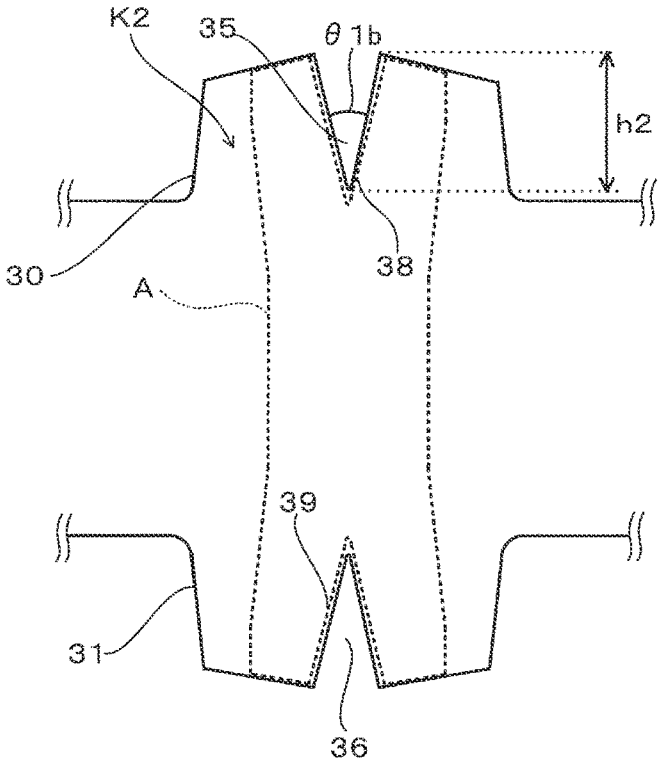
FIG. 3 is a schematic explanatory diagram of a second caliber.

FIG. 3 is a schematic explanatory diagram of a second caliber K2. The second caliber K2 is engraved on a pair of horizontal rolls, an upper caliber roll 30 and a lower caliber roll 31. On a peripheral surface of the upper caliber roll 30 (i.e., a top surface of the second caliber K2), a projection 35 protruding toward the inside of the caliber is formed. Furthermore, on a peripheral surface of the lower caliber roll 31 (i.e., a bottom surface of the second caliber K2), a projection 36 protruding toward the inside of the caliber is formed. These projections 35 and 36 have tapered shapes, and dimensions, such as protrusion length, are configured to be equal between the projections 35 and 36. The tip-portion angle θ1*b* (wedge angle θ1*b*) of the projections 35 and 36 is preferably equal to or more than 25° and equal to or less than 40°, further preferably equal to or more than 25° and equal to or less than 35°.

Here, description is given on reasons for setting the suitable numerical range of the wedge angle θ1*b* of the projections 35 and 36 to equal to or more than 25° and equal to or less than 40° (further preferably equal to or more than 25° and equal to or less than 35°) and a reason for accordingly setting the wedge angle θ1*a* of the first caliber K1 to the suitable numerical range.

A lower limit value of a wedge angle is normally decided by the strength of a roll. The material to be rolled A comes into contact with the rolls (the upper caliber roll 30 and the lower caliber roll 31 in the second caliber K2, and the upper caliber roll 20 and the lower caliber roll 21 in the first caliber K1), and the rolls are subjected to heat during the contact to swell, and when the material to be rolled A goes out of contact with the rolls, the rolls are cooled to shrink. This cycle is repeated during shaping; when the wedge angle is too small, the projections (the projections 35 and 36 in the second caliber K2, and the projections 25 and 26 in the first caliber K1) have small thicknesses, and this makes heat input from the material to be rolled A easily enter from the left and right of the projections, making the rolls have higher temperatures. When the rolls have high temperatures, thermal amplitude increases to cause a heat crack, which may break the rolls. For this reason, the wedge angles θ1*a* and θ1*b* are both preferably 25° or more.

On the other hand, when the wedge angles θ1*a* and θ1*b* are large, wedge inclination angles are enlarged, which makes pressing force in the up-and-down direction due to friction force easily act on the material to be rolled A; thus, a reduction in cross-sectional area occurs at inner surface portions of flange-corresponding portions in split formation, causing a decrease in efficiency in generating flanges particularly in shaping using the second caliber K2 and subsequent calibers. Here, the relation between the wedge angle θ1*b* of the second caliber K2 and a flange width of the material to be rolled A that is finally shaped is described, and a suitable upper limit value of the wedge angle θ1*b* is described, with reference to FIG. 13.

Figure 13:
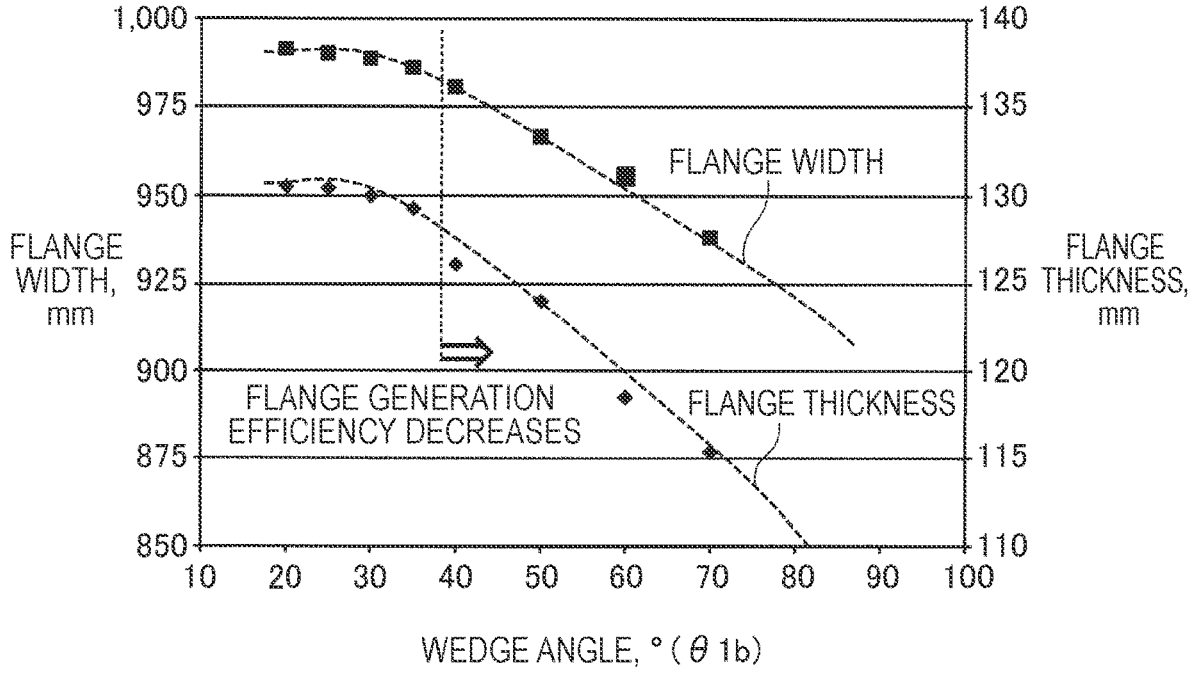
FIG. 13 is a graph showing the relation with numerical values of flange width and flange thickness when a wedge angle θ1*b* is changed.

FIG. 13 shows analysis results by a FEM, and is a graph showing the relation with numerical values of flange thickness and flange width in a subsequent step (a step using a third caliber K3 described later) when the wedge angle θ1*b* of the second caliber K2 is changed. As calculation conditions, a slab width and a slab thickness of a material are set to 2300 mm and 300 mm, respectively, and a method described in the present embodiment is used, assuming that the material to be rolled A is shaped with the wedge angle θ1*b* changed among predetermined angles, about 20° to about 70°.

As shown in FIG. 13, the graph shows that in the case where the rough rolling step is performed with the wedge angle θ1*b* set to more than 40° and an H-shaped steel product is shaped, flange width and flange thickness both decrease significantly, which indicates a decrease in efficiency in generating flanges. That is, in the case where the wedge angle θ1*b* is set to more than 40°, the graph is significantly steep, and flange width and flange thickness decrease greatly, as compared with the case where the wedge angle θ1*b* is 40° or less. As the wedge angle θ1*b* becomes more obtuse, a reduction in cross-sectional area at the flange-corresponding portions (induction of metal flow in the longitudinal direction of the material to be rolled A) increases. From this viewpoint, setting the wedge angle θ1*b* to 40° or less enables high efficiency in generating flanges to be achieved. In addition, FIG. 13 shows that it is preferable to set the wedge angle θ1*b* to 35° or less to achieve higher efficiency in generating flanges.

Moreover, for high inductivity and secured rolling stability, the wedge angle θ1*a* of the first caliber K1 is preferably the same angle as the wedge angle θ1*b* of the second caliber K2 subsequent to the first caliber K1.

Figure 14:
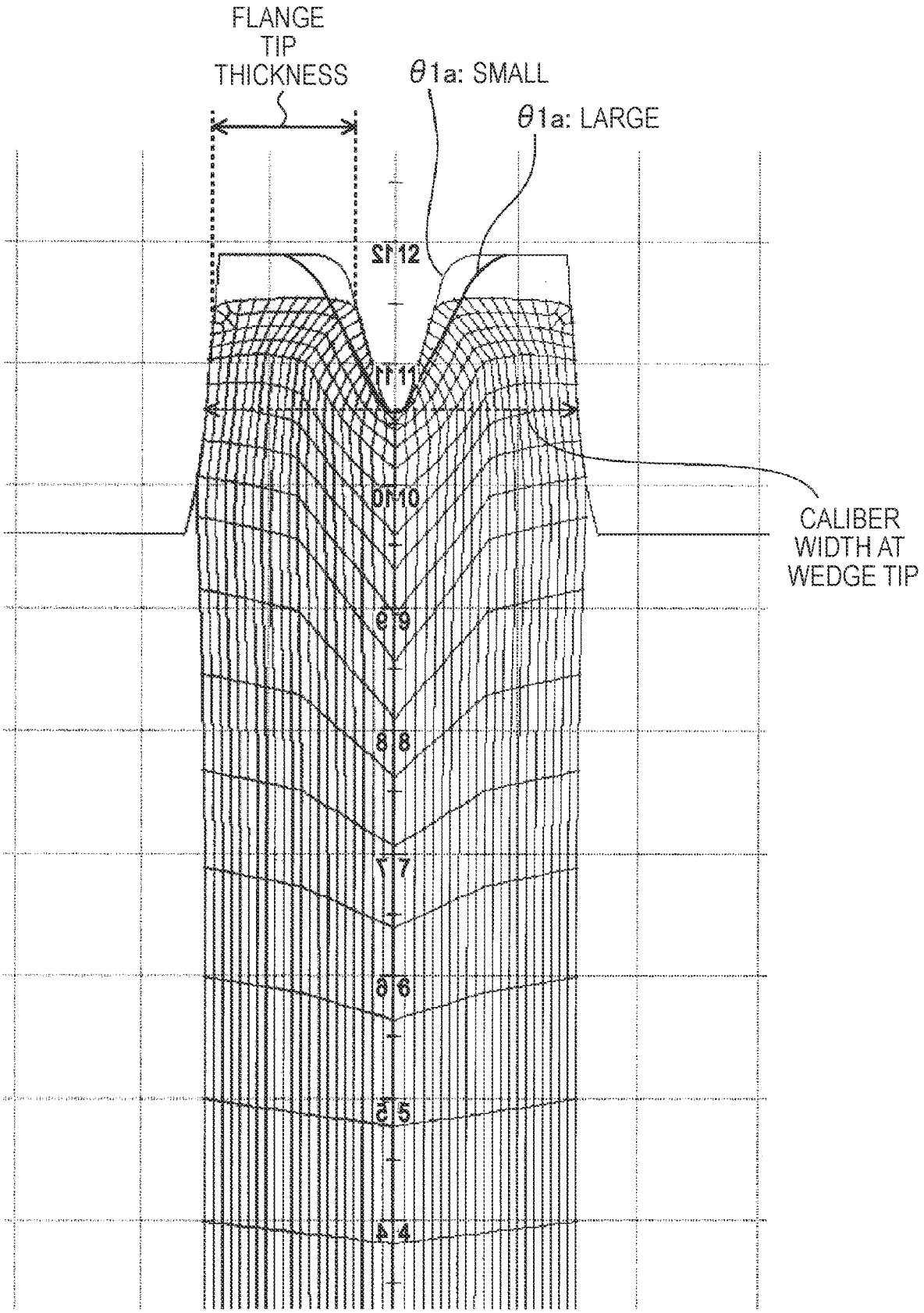
FIG. 14 is a schematic cross-sectional view of an intermediate pass of the first caliber.
Figure 15:
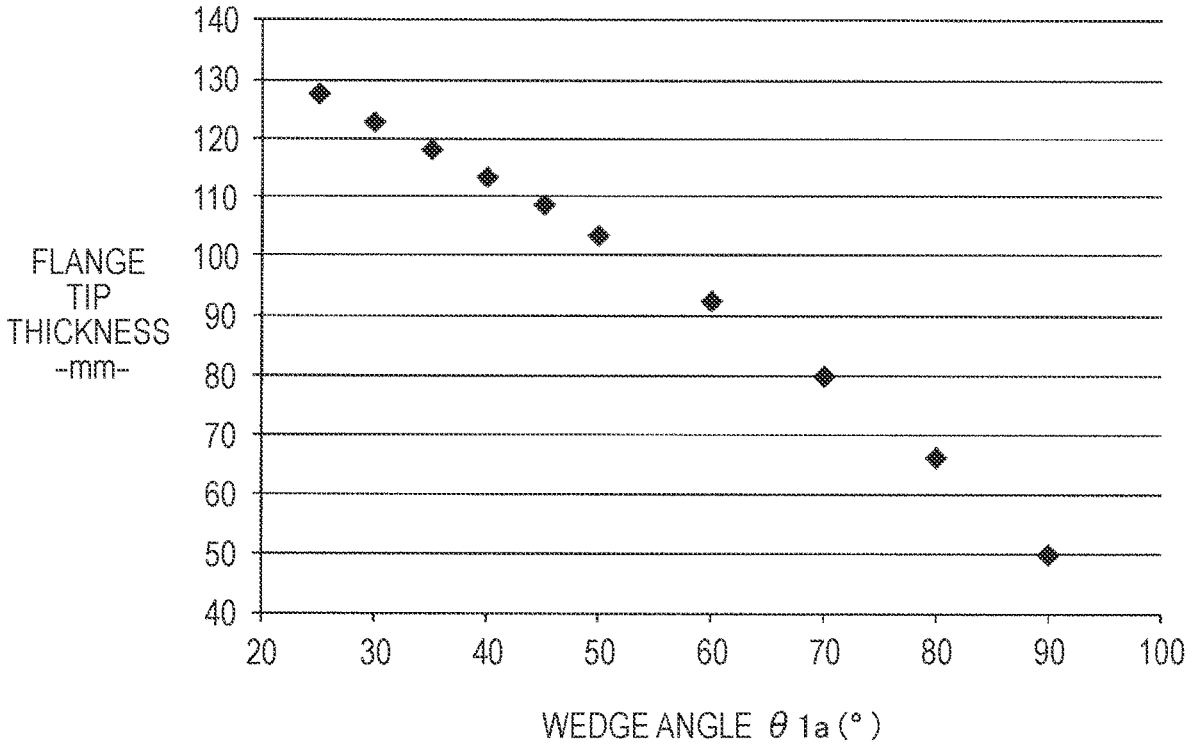
FIG. 15 is a graph showing the relation with numerical values of flange tip thickness when a wedge angle θ1*a* is changed.

In particular, the wedge angle θ1*a* of the first caliber K1 is known to greatly contribute to tip-portion thicknesses of the flange-corresponding portions (later flange portions 80); in this respect, the wedge angle θ1*a* is preferably as small as possible. FIG. 14 is a schematic cross-sectional view of an intermediate pass of the first caliber K1, and illustrates a state where the split 28 is provided on one slab end surface (the upper end portion in FIG. 2). FIG. 14 shows a difference due to the magnitude of the wedge angle θ1*a* in providing the split 28, illustrating the split shape in each case. FIG. 15 is a graph showing the relation between the wedge angle θ1*a* of the first caliber K1 and a tip thickness of a flange-corresponding portion (flange tip thickness), and shows a case where a wedge height is 100 mm and a slab thickness is 300 mm, as an example.

As shown in FIGS. 14 and 15, in a cross-section when the wedge angle θ1*a* is large, metal at slab end surfaces is lessened, which leads to a decrease in tip-portion thicknesses of the flange-corresponding portions (later flange portions 80) of the slab end surfaces, as compared with a cross-section when the wedge angle θ1*a* is small. The decrease in tip-portion thicknesses of the flange-corresponding portions (later flange portions 80) is not preferable in view of the shape of a later H-shaped steel product; hence, to ensure the tip-portion thicknesses of the flange-corresponding portions, it is necessary to determine a suitable upper limit value of the wedge angle θ1*a*.

As described above, in addition to setting the wedge angle θ1*b* of the second caliber K2 to equal to or more than 25° and equal to or less than 40°, it is preferable to set the wedge angle θ1*a* of the first caliber K1 to equal to or more than 25° and equal to or less than 40°, from the viewpoints of ensuring the tip-portion thicknesses of the flange-corresponding portions and securing inductivity and rolling stability. Furthermore, from the viewpoint of achieving high efficiency in generating flanges, it is preferable to set these wedge angles θ1*a* and θ1*b* to equal to or more than 25° and equal to or less than 35°.

To ensure the tip-portion thicknesses of the flange-corresponding portions, increase inductivity, and secure rolling stability, it is preferable to set the wedge angle θ1*a* of the first caliber K1 to the same angle as the wedge angle θ1*b* of the second caliber K2 subsequent to the first caliber K1.

A height (protrusion length) h2 of the projections 35 and 36 is configured to be larger than the height h1 of the projections 25 and 26 of the first caliber K1; h2>h1 is satisfied.

As described above, the height h2 of the projections 35 and 36 formed in the second caliber K2 is larger than the height h1 of the projections 25 and 26 formed in the first caliber K1, and similarly, an intrusion length into the upper and lower end portions of the material to be rolled A (the slab end surfaces) is larger for the second caliber K2. Here, an intrusion depth of the projections 35 and 36 into the material to be rolled A in the second caliber K2 is the same as the height h2 of the projections 35 and 36. That is, an intrusion depth h1' of the projections 25 and 26 into the material to be rolled A in the first caliber K1 and an intrusion depth h2 of the projections 35 and 36 into the material to be rolled A in the second caliber K2 satisfy a relation of h1'<h2.

As illustrated in FIG. 3, in the second caliber K2, since the intrusion length of the projections is large when the projections are pressed against the upper and lower end portions of the material to be rolled A (the slab end surfaces), shaping is performed to make the splits 28 and 29 formed in the first caliber K1 further deeper, forming splits 38 and 39. Note that a flange half-width at the end of a flange shaping step in the rough rolling step is decided on the basis of dimensions of the splits 38 and 39 formed here.

Shaping using the second caliber K2 illustrated in FIG. 3 is performed through multiple passes, and in at least one pass of this multi-pass shaping, the upper and lower end portions of the material to be rolled A (the slab end surfaces) need to be in contact with the inside of the caliber (the top surface and the bottom surface of the second caliber K2). Note that contact is not preferred in all the passes; for example, it is preferable that the upper and lower end portions of the material to be rolled A (the slab end surfaces) be in contact with the inside of the caliber only in the final pass and the amount of reduction ΔE at slab end surfaces be a positive value (ΔE>0). This is because if the upper and lower end portions of the material to be rolled A are out of contact with the inside of the caliber in all the passes in the second caliber K2, shape defects may occur (e.g., flange-corresponding portions (the flange portions 80 described later) may be shaped with left-right asymmetry), which is problematic in terms of material-passing property.

On the other hand, in other passes, the caliber is not in contact with the material to be rolled A, besides the projections 35 and 36, at the upper and lower end portions of the material to be rolled A (the slab end surfaces), and active reduction is not performed on the material to be rolled A in these passes. This is because reduction causes stretch of the material to be rolled A in the longitudinal direction, which decreases efficiency in generating the flange-corresponding portions (corresponding to the flange portions 80 described later).

That is, in multi-pass shaping using the second caliber K2, it is preferable to set a pass schedule in which reduction is performed by bringing the upper and lower end portions of the material to be rolled A (the slab end surfaces) into contact with the inside of the caliber in minimum necessary passes (e.g., only the final pass), and active reduction is not performed in other passes. Also in this second caliber K2, as with the first caliber K1, an amount of reduction at the projections 35 and 36 (amount of reduction ΔT at wedge tips) is set to be sufficiently larger than an amount of reduction at the slab upper and lower end portions (amount of reduction ΔE at slab end surfaces); thus, the splits 38 and 39 are formed.

Figure 4:
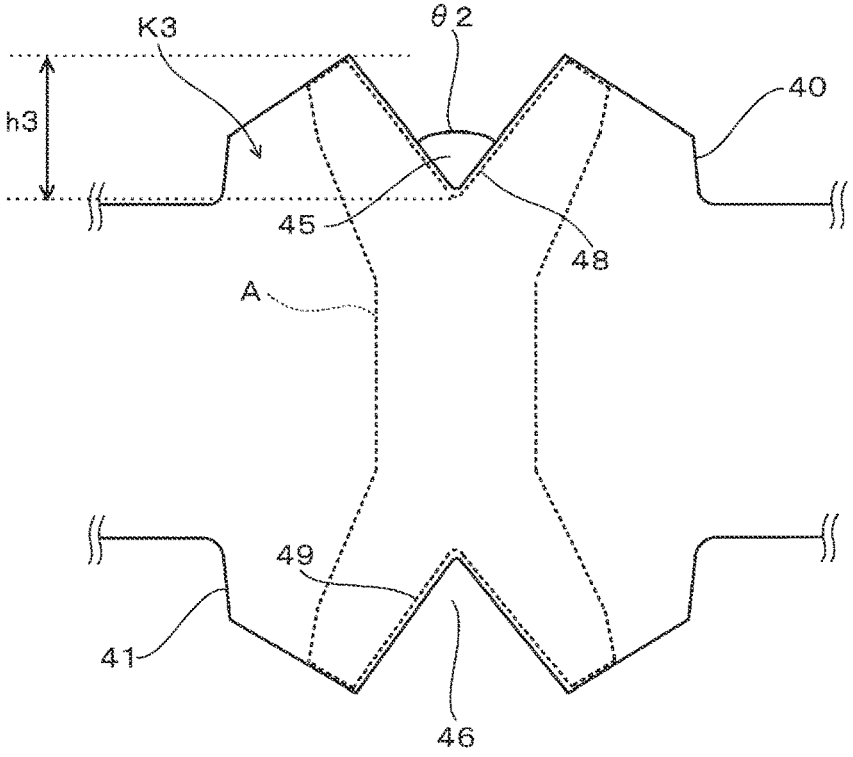
FIG. 4 is a schematic explanatory diagram of a third caliber.

FIG. 4 is a schematic explanatory diagram of a third caliber K3. The third caliber K3 is engraved on a pair of horizontal rolls, an upper caliber roll 40 and a lower caliber roll 41. On a peripheral surface of the upper caliber roll 40 (i.e., a top surface of the third caliber K3), a projection 45 protruding toward the inside of the caliber is formed. Furthermore, on a peripheral surface of the lower caliber roll 41 (i.e., a bottom surface of the third caliber K3), a projection 46 protruding toward the inside of the caliber is formed. These projections 45 and 46 have tapered shapes, and dimensions, such as protrusion length, are configured to be equal between the projections 45 and 46.

A tip-portion angle θ2 of the projections 45 and 46 is configured to be wider than the angle θ1*b*, and an intrusion depth h3 of the projections 45 and 46 into the material to be rolled A is shorter than the intrusion depth h2 of the projections 35 and 36 (i.e. h3<h2).

As illustrated in FIG. 4, in the third caliber K3, the material to be rolled A that has passed through the second caliber K2 is shaped in the following manner: the projections 45 and 46 are pressed against the splits 38 and 39 formed in the second caliber K2, at the upper and lower end portions of the material to be rolled A (the slab end surfaces); thus, the splits 38 and 39 become splits 48 and 49. That is, in a final pass in shaping using the third caliber K3, a deepest-portion angle of the splits 48 and 49 (hereinafter also called a split angle) becomes θ2. In other words, shaping is performed in a manner that the divided parts (flange-corresponding portions; parts corresponding to the flange portions 80 described later) shaped together with the formation of the splits 38 and 39 in the second caliber K2 are bent outwardly.

Shaping using the third caliber K3 illustrated in FIG. 4 is performed through at least one pass, and in at least one pass of this shaping, the upper and lower end portions of the material to be rolled A (the slab end surfaces) need to be in contact with the inside of the caliber (the top surface and the bottom surface of the third caliber K3). Note that contact is not preferred in all the passes; for example, it is preferable that the upper and lower end portions of the material to be rolled A (the slab end surfaces) be in contact with the inside of the caliber only in the final pass and the amount of reduction ΔE at slab end surfaces be a positive value (ΔE>0). This is because if the upper and lower end portions of the material to be rolled A are out of contact with the inside of the caliber in all the passes in the third caliber K3, shape defects may occur (e.g., flange-corresponding portions (the flange portions 80 described later) may be shaped with left-right asymmetry), which is problematic in terms of material-passing property.

On the other hand, in other passes, the caliber is not in contact with the material to be rolled A, besides the projections 45 and 46, at the upper and lower end portions of the material to be rolled A (the slab end surfaces), and active reduction is not performed on the material to be rolled A in these passes. This is because reduction causes stretch of the material to be rolled A in the longitudinal direction, which decreases efficiency in generating the flange-corresponding portions (corresponding to the flange portions 80 described later).

Figure 5:
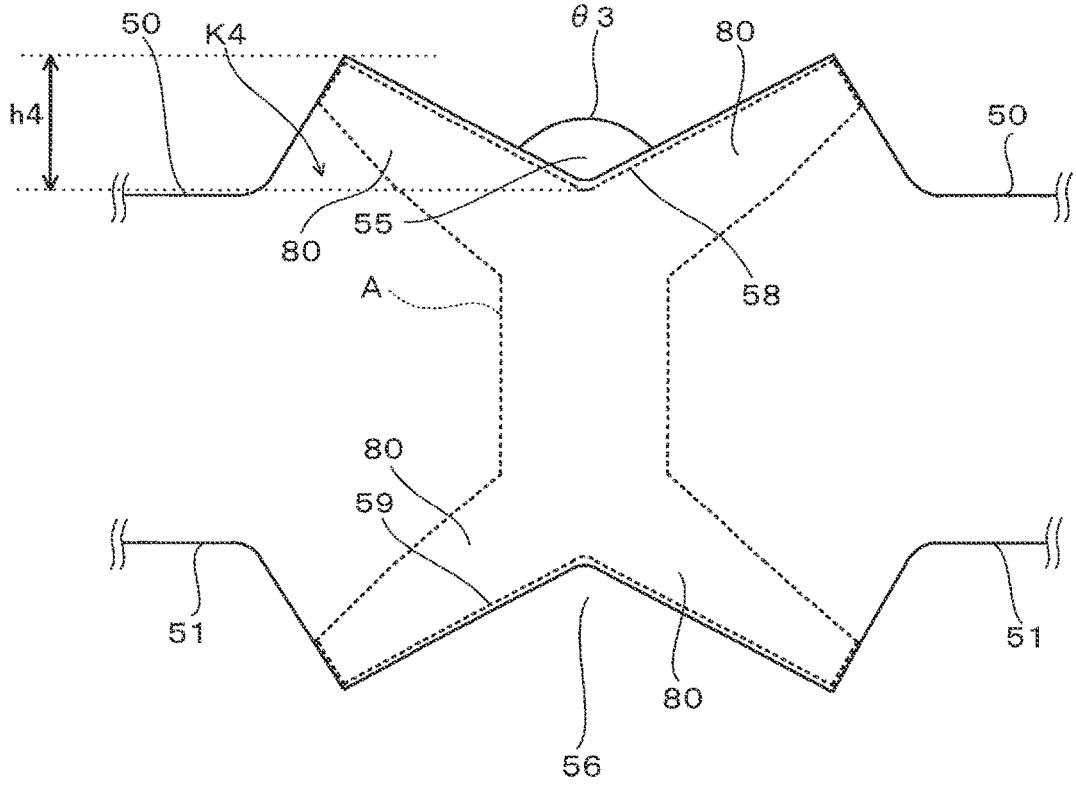
FIG. 5 is a schematic explanatory diagram of a fourth caliber.

FIG. 5 is a schematic explanatory diagram of a fourth caliber K4. The fourth caliber K4 is engraved on a pair of horizontal rolls, an upper caliber roll 50 and a lower caliber roll 51. On a peripheral surface of the upper caliber roll 50 (i.e., a top surface of the fourth caliber K4), a projection 55 protruding toward the inside of the caliber is formed. Furthermore, on a peripheral surface of the lower caliber roll 51 (i.e., a bottom surface of the fourth caliber K4), a projection 56 protruding toward the inside of the caliber is formed. These projections 55 and 56 have tapered shapes, and dimensions, such as protrusion length, are configured to be equal between the projections 55 and 56.

A tip-portion angle θ3 of the projections 55 and 56 is configured to be wider than the angle θ2, and an intrusion depth h4 of the projections 55 and 56 into the material to be rolled A is shorter than the intrusion depth h3 of the projections 45 and 46 (i.e. h4<h3).

In the fourth caliber K4, the material to be rolled A that has passed through the third caliber K3 is shaped in the following manner: the projections 55 and 56 are pressed against the splits 48 and 49 formed in the third caliber K3, at the upper and lower end portions of the material to be rolled A (the slab end surfaces); thus, the splits 48 and 49 are expanded to become splits 58 and 59. That is, in a final pass in shaping using the fourth caliber K4, a deepest-portion angle of the splits 58 and 59 (hereinafter also called a split angle) becomes θ3. In other words, shaping is performed in a manner that the divided parts (parts corresponding to the flange portions 80 described later) shaped together with the formation of the splits 48 and 49 in the third caliber K3 are further bent outwardly. The parts at the upper and lower end portions of the material to be rolled A shaped in this manner are parts corresponding to flanges of a later H-shaped steel product, and are called flange portions 80 here. Note that the split angle θ3 of the fourth caliber K4 is preferably set to an angle somewhat smaller than 180°. This is because if the split angle θ3 is 180°, spread occurs at the outer side of the flange portions 80 when web thickness is decreased in a web thinning caliber in the next step, and overfill is likely to occur in rolling using the web thinning caliber. That is, since the amount of spread at the outer side of the flange portions 80 is decided by the shape of the web thinning caliber in the next step and an amount of reduction of the web thickness, the split angle θ3 here is preferably determined suitably with the shape of the web thinning caliber and the amount of reduction of the web thickness taken into consideration.

Shaping using the fourth caliber K4 illustrated in FIG. 5 is performed through at least one pass, and in at least one pass of this multi-pass shaping, the upper and lower end portions of the material to be rolled A (the slab end surfaces) need to be in contact with the inside of the caliber (the top surface and the bottom surface of the fourth caliber K4). Note that contact is not preferred in all the passes; for example, it is preferable that the upper and lower end portions of the material to be rolled A (the slab end surfaces) be in contact with the inside of the caliber only in the final pass and the amount of reduction ΔE at slab end surfaces be a positive value (ΔE>0). This is because if the upper and lower end portions of the material to be rolled A are out of contact with the inside of the caliber in all the passes in the fourth caliber K4, shape defects may occur (e.g., flange-corresponding portions (the flange portions 80 described later) may be shaped with left-right asymmetry), which is problematic in terms of material-passing property.

On the other hand, in other passes, the caliber is not in contact with the material to be rolled A, besides the projections 55 and 56, at the upper and lower end portions of the material to be rolled A (the slab end surfaces), and active reduction is not performed on the material to be rolled A in these passes. This is because reduction causes stretch of the material to be rolled A in the longitudinal direction, which decreases efficiency in generating the flange portions 80.

The material to be rolled A shaped by the first to fourth calibers K1 to K4 described above is further subjected to reduction and shaping using a known caliber; thus, the H-shaped raw blank 13 with a so-called dog-bone shape is shaped. Normally, web thickness is then decreased in a web thinning caliber for thinning a portion corresponding to slab thickness. After that, reverse rolling of a plurality of passes is performed using a rolling mill train composed of two rolling mills of the intermediate universal rolling mill 5 and the edger rolling mill 9, which is illustrated in FIG. 1; thus, the intermediate material 14 is shaped. The intermediate material 14 is finish-rolled into a product shape in the finishing universal rolling mill 8, so that the H-shaped steel product 16 is produced.

In producing the H-shaped steel product 16 described above, the formation of the splits 28 and 29 using the projections 25 and 26 in the first caliber K1 illustrated in FIG. 2 and the formation of the splits 38 and 39 using the projections 35 and 36 in the second caliber K2 illustrated in FIG. 3 are preferably performed so as to satisfy predetermined conditions to make cross-sectional area uniform between flange-corresponding portions (flange portions 80) shaped at four places of the material to be rolled A and improve material-passing property in the second caliber K2. Hence, the present inventors carried out extensive studies on conditions that make cross-sectional area uniform between flange-corresponding portions and improve material-passing property in shaping using the second caliber K2 and subsequent calibers (the third to fourth calibers K3 to K4). Description on the studies is given below with reference to drawings.

Figure 6:
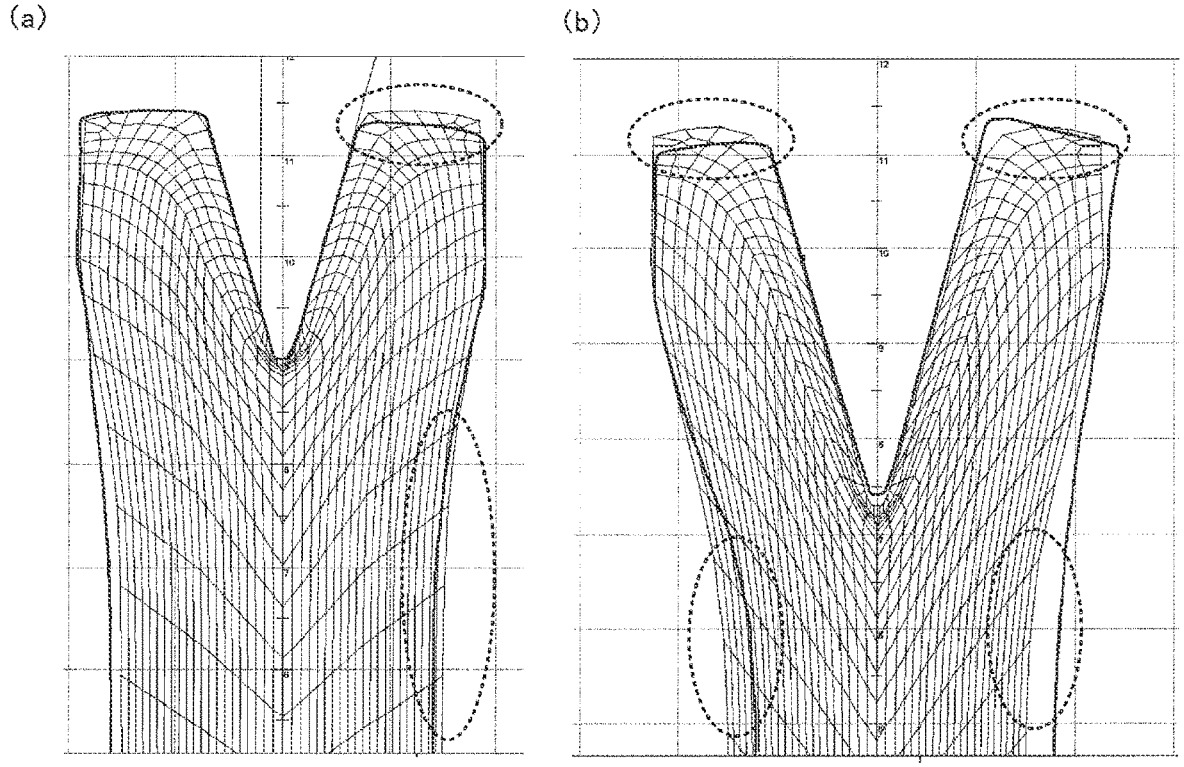
FIG. 6 is a schematic explanatory diagram illustrating an intermediate pass (a) and a final pass (b) in the following case: in the first caliber, grooving is performed on upper and lower end portions of a material to be rolled by using projections with conventionally known dimensions, and after that splits are formed by using the second caliber.

FIG. 6 is a schematic explanatory diagram illustrating an intermediate pass (a) and a final pass (b) in the following case: in the first caliber K1, grooving is performed on the upper and lower end portions of the material to be rolled A (the slab end surfaces) by using projections with conventionally known dimensions, as described in Patent Literatures 1 and 2, for example, and after that the splits 38 and 39 are formed by using the second caliber K2 illustrated in FIG. 3. Note that the solid line in FIG. 6 is a schematic diagram of the material to be rolled, and the mesh pattern shows a desired shape of the material to be rolled.

In split formation according to a conventional method, in the intermediate pass in split formation using the second caliber K2, the slab end surface and the slab thickness are ununiform between left and right (see dotted-line portions in the drawing), and the actual shape differs from the desired shape of the material to be rolled, as illustrated in FIG. 6(*a*). Furthermore, at the stage of the final pass after such an intermediate pass, the ununiformity of the slab end surface and the slab thickness between the left and right becomes significant (see dotted-line portions in the drawing), as illustrated in FIG. 6(*b*). Note that the height of the projection in split formation according to the conventional method here is approximately 80 mm, for example.

In view of such problems illustrated in FIG. 6, the present inventors found that there is a problem in split formation using the first caliber according to the conventional method, and also found that particularly for a material to be rolled A with a large slab width, split formation is performed on the skew when the slab is caught in the caliber in a state of being rotated from a desired position. Moreover, in shaping in the second caliber and subsequent calibers, shaping proceeds in a state where the left and right of the material to be rolled A are not restrained, as is apparent from FIGS. 3 to 5; thus, shaping proceeds without the problems illustrated in FIG. 6 being corrected.

Here, in a conventional technology, the slab end surface and the slab thickness are already ununiform between the left and right in the intermediate pass of the second caliber K2, as illustrated in FIG. 6(*a*); in view of this fact, the present inventors carried out extensive studies on shaping in the first caliber K1, which is a preceding caliber, and found that it is effective to make the height of the projections 25 and 26 (hereinafter also referred to as a wedge height) in the first caliber K1 larger than a conventional height to improve inductivity for the material to be rolled A in subsequent calibers (the second caliber K2 and subsequent calibers). Moreover, it was found that in increasing the wedge height in the first caliber K1, it is preferable to set a height that satisfies a predetermined condition. Description on this finding is given below.

The present inventors carried out studies on a case where shaping of H-shaped steel is performed by using three types of slabs having a slab thickness of 300 mm and a slab width of 2300 mm, a slab thickness of 300 mm and a slab width of 1800 mm, a slab thickness of 250 mm and a slab width of 1200 mm, as a material slab serving as the material to be rolled A. Specifically, in a shaping process using the four calibers described with reference to FIGS. 2 to 5, the wedge height of the first caliber K1 was fluctuated, and thickness variations of left and right flange-corresponding portions after rolling using the third caliber K3 were measured.

Figure 7:
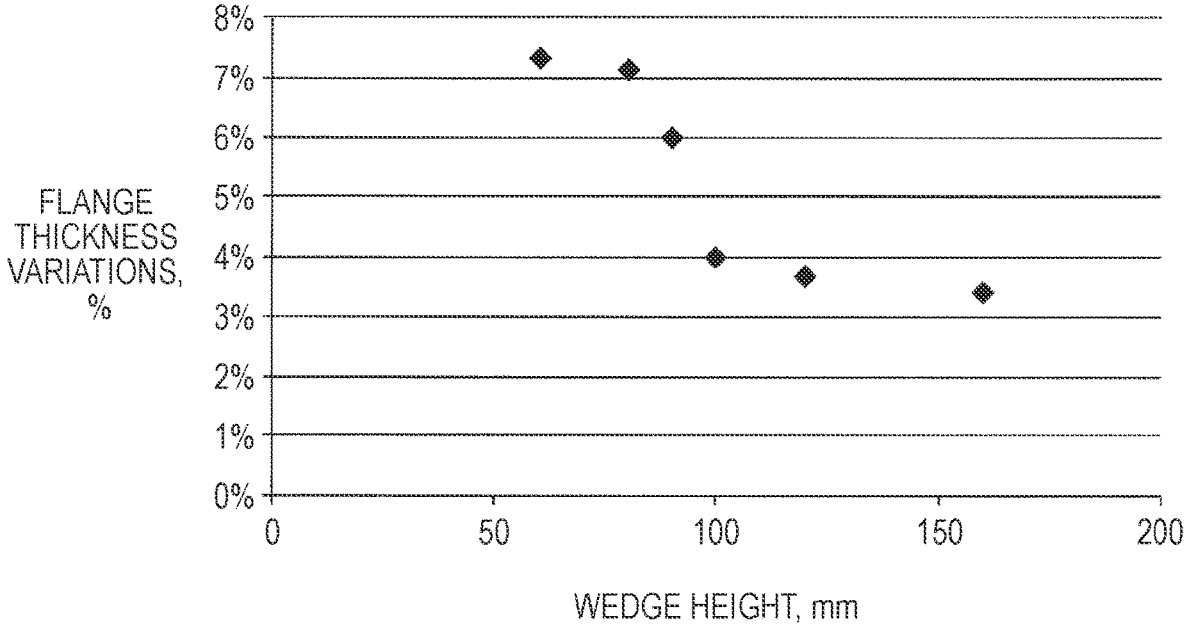
FIG. 7 is a graph showing the relation between a wedge height of the first caliber and thickness variations of left and right flange-corresponding portions after rolling using the third caliber when a slab with a thickness of 300 mm and a width of 2300 mm is used as a material.

FIG. 7 is a graph showing the relation between the wedge height of the first caliber K1 and thickness variations of left and right flange-corresponding portions (flange thickness variations) after rolling using the third caliber K3 when the slab with a thickness of 300 mm and a width of 2300 mm was used as a material. Here, flange thickness variations, the vertical axis of the graph in FIG. 7, indicate variations 3σ from the average flange thickness of four flange-corresponding portions shaped by expanding splits.

FIG. 7 shows that in the case where the wedge height of the first caliber K1 was set to 100 mm or more, flange thickness variations were greatly decreased. That is, it is shown that in the case where shaping of H-shaped steel according to the present embodiment is performed with the slab with a thickness of 300 mm and a width of 2300 mm used as a material, setting the wedge height of the first caliber K1 to 100 mm or more decreases flange thickness variations in subsequent shaping.

Thickness variations of left and right flange-corresponding portions are preferably suppressed to 5% or less. According to JIS standard (JIS G 3192), an allowance of shape dimensions of large-size H-shaped steel is as follows: in the case where a flange thickness exceeds 40 mm, tolerance of the flange thickness is 4 mm (i.e., ±2 mm), which corresponds to 10% of a flange thickness of a product. In the case where flange dimensions of a product are out of the tolerance, correction by working is difficult, and the product is not recognized as a product with predetermined quality, which is problematic in terms of production efficiency and cost. Accordingly, it is necessary to ensure sufficient process capability in each shaping step and suppress thickness variations of left and right flange-corresponding portions in producing an H-shaped steel product. Normally, it is preferable to set tolerance of a flange thickness to 6σ to ensure sufficient process capability in each shaping step. To match 10% of a flange thickness of an H-shaped steel product with 6σ on the basis of the HS standard, it is preferable to set the target value of thickness variations 3σ of left and right flange-corresponding portions to 5% or less.

Figure 8:
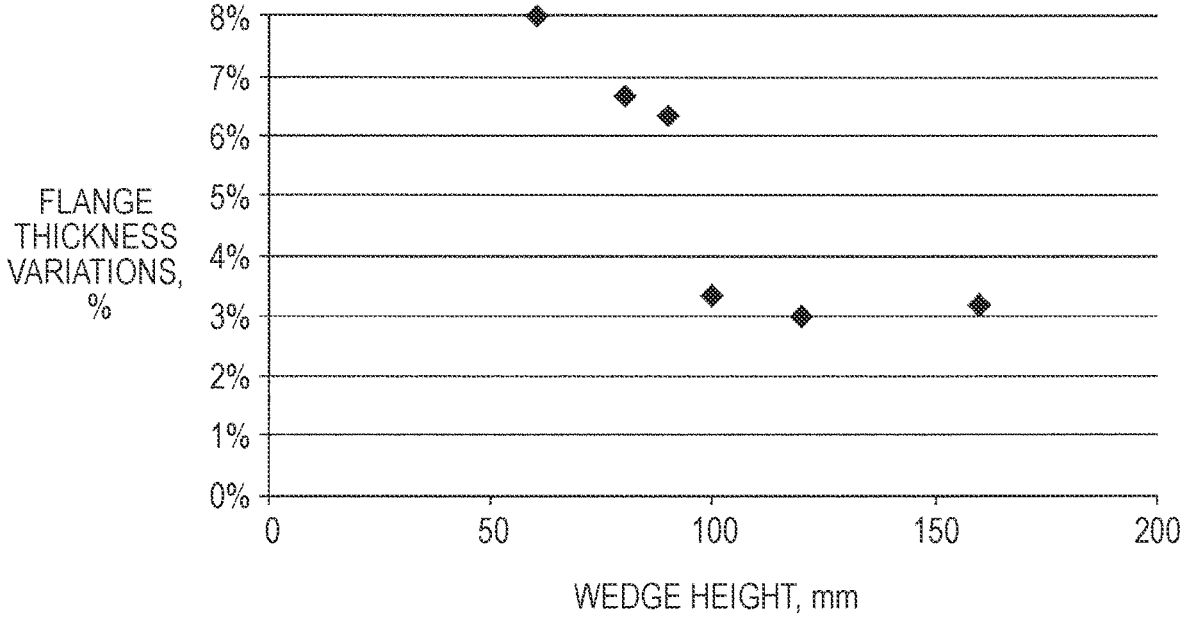
FIG. 8 is a graph showing the relation between a wedge height of the first caliber and thickness variations of left and right flange-corresponding portions after rolling using the third caliber when a slab with a thickness of 300 mm and a width of 1800 mm is used as a material.

FIG. 8 is a graph showing the relation between the wedge height of the first caliber K1 and thickness variations of left and right flange-corresponding portions (flange thickness variations) after rolling using the third caliber K3 when the slab with a thickness of 300 mm and a width of 1800 mm was used as a material. FIG. 8 shows that in the case where the wedge height of the first caliber K1 was set to 100 mm or more, flange thickness variations were greatly decreased to be 5% or less. That is, it is shown that in the case where shaping of H-shaped steel according to the present embodiment is performed with the slab with a thickness of 300 mm and a width of 1800 mm used as a material, setting the wedge height of the first caliber K1 to 100 mm or more decreases flange thickness variations in subsequent shaping.

Figure 9:
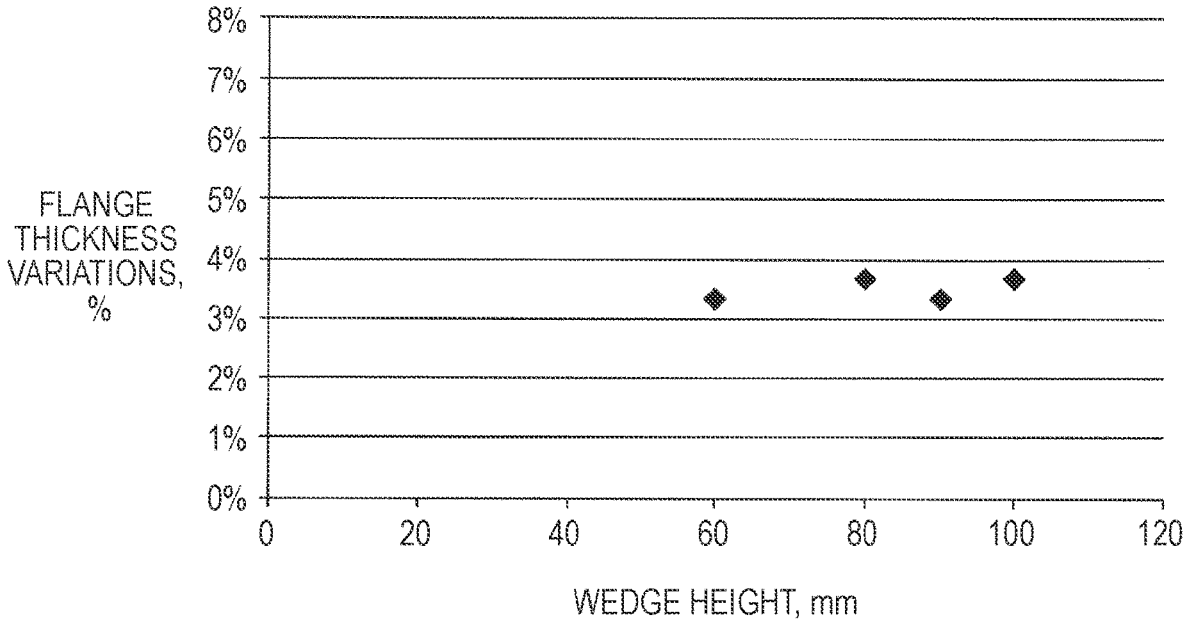
FIG. 9 is a graph showing the relation between a wedge height of the first caliber and thickness variations of left and right flange-corresponding portions after rolling using the third caliber when a slab with a thickness of 250 mm and a width of 1200 mm is used as a material.

FIG. 9 is a graph showing the relation between the wedge height of the first caliber K1 and thickness variations of left and right flange-corresponding portions (flange thickness variations) after rolling using the third caliber K3 when the slab with a thickness of 250 mm and a width of 1200 mm was used as a material. FIG. 9 shows that in each case where the wedge height of the first caliber K1 was set to 60 mm or more, flange thickness variations were 5% or less. That is, it is shown that in the case where shaping of H-shaped steel according to the present embodiment is performed with the slab with a thickness of 250 mm and a width of 1200 mm used as a material, setting the wedge height of the first caliber K1 to 60 mm or more decreases flange thickness variations in subsequent shaping.

As shown by the above finding, in the case where shaping of H-shaped steel according to the present embodiment is performed with a slab with predetermined dimensions used as a material, setting the wedge height of the first caliber K1 to a predetermined height or more decreases flange thickness variations in subsequent shaping, making thickness variations of left and right flange-corresponding portions after rolling using the third caliber K3 equal to or less than 5%, for example.

According to studies by the present inventors, it has been found that a ratio between width and thickness of a material slab (=slab width/slab thickness) is related to flange thickness variations in shaping. That is, the ratio of slab width/slab thickness of the material slab has been found to be associated with ease of rotation of the material to be rolled in the caliber; for example, larger slab width/slab thickness makes rotation easier and smaller slab width/slab thickness makes rotation more difficult. Values of slab width/slab thickness in the cases shown in FIGS. 7 to 9 are 7.7, 6.0, and 4.8, respectively.

In the case where slab width/slab thickness is small as shown in FIG. 9, rotation of the material to be rolled is suppressed and rolling is stabilized; consequently, flange thickness variations in shaping are less likely to occur. That is, even if the wedge height of the first caliber K1 is small to some degree, significant flange thickness variations in shaping do not occur.

On the other hand, in the case where slab width/slab thickness is large as shown in FIGS. 7 and 8, setting the wedge height of the first caliber K1 to a height larger than a predetermined condition suppresses rotation of the material to be rolled, decreasing flange thickness variations in shaping.

As shown in FIGS. 7 to 9, it has been found that in each case where the wedge height of the first caliber K1 is set to 100 mm or more, flange thickness variations in subsequent shaping can be decreased. In particular, FIGS. 7 and 8 show that in the case where slab width/slab thickness of the material slab is equal to or more than 6.0 and equal to or less than 7.7, setting the wedge height of the first caliber K1 to 100 mm or more suppresses thickness variations of left and right flange-corresponding portions after rolling using the third caliber K3 to 5% or less.

These facts show that when slab width/slab thickness of the material slab is equal to or more than 6.0 and equal to or less than 7.7, setting the wedge height of the first caliber K1 to 100 mm or more decreases flange thickness variations in subsequent shaping, making thickness variations of left and right flange-corresponding portions after rolling using the third caliber K3 equal to or less than 5%, for example.

As described above, when a slab with predetermined dimensions is used as a material and the wedge height of the first caliber K1 is set to a height larger than a conventional height to fall within a suitable range, in shaping of the material to be rolled A using subsequent calibers (e.g., the second caliber K2 and the third caliber K3), a difference in cross-sectional area between left and right flange-corresponding portions can be decreased, leading to a decrease in thickness variations, and material-passing property can be improved. This improves dimensional accuracy of an H-shaped steel product after shaping.

The embodiment(s) of the present invention has/have been described above, whilst the present invention is not limited to the illustrated examples. A person skilled in the art may find various alterations and modifications within the scope of the appended claims, and it should be understood that they will naturally come under the technical scope of the present invention.

For example, the above embodiment describes that for shaping of the material to be rolled A using the first caliber K1 described with reference to FIG. 2, the wedge height of the projections 25 and 26 is set to be larger than a conventional wedge height, and this improves inductivity for the material to be rolled A in subsequent calibers (the second caliber K2 and subsequent calibers), and enables a decrease in thickness variations of left and right flange-corresponding portions and an improvement in material-passing property; however, an increase in the wedge height of the projections 25 and 26 in the first caliber K1 makes the projections 25 and 26 create greater splits, and may cause overfill of metal in side-wall portions of the first caliber K1, depending on the wedge angle of the projections 25 and 26.

Figure 10:
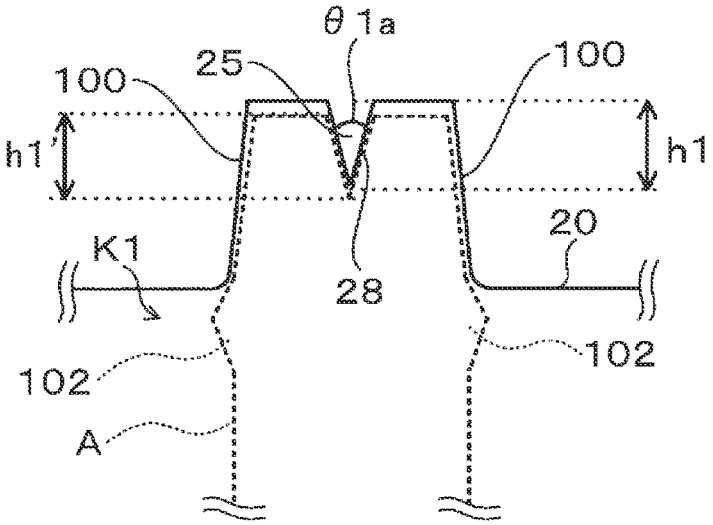
FIG. 10 is an explanatory diagram related to overfill of metal in the first caliber.

FIG. 10 is an explanatory diagram related to overfill of metal in the first caliber K1. Note that in FIG. 10, structural elements described in the above embodiment are denoted with the same reference numerals and description thereof is omitted. As illustrated in FIG. 10, in the case where the wedge angle θ1*a* is particularly large in shaping using the first caliber K1, overfill of metal occurs in side-wall portions 100 of the first caliber K1 in some cases, and thus overfill portions 102 are formed, as illustrated, in the material to be rolled A in some cases. In the case where the overfill portions 102 are formed in shaping using the first caliber K1, reduction that corrects the overfill portions 102 is not performed in subsequent calibers (the second to fourth calibers K2 to K4); thus, shape defects due to these overfill portions 102 occur in flanges of an H-shaped steel product that is finally shaped.

In view of such circumstances, the present inventors found that providing relief portions for releasing metal at the material-to-be-rolled entry side of the side-wall portions 100 in the first caliber K1 prevents formation of the overfill portions 102. These relief portions will be described with reference to FIG. 11.

Figure 11:
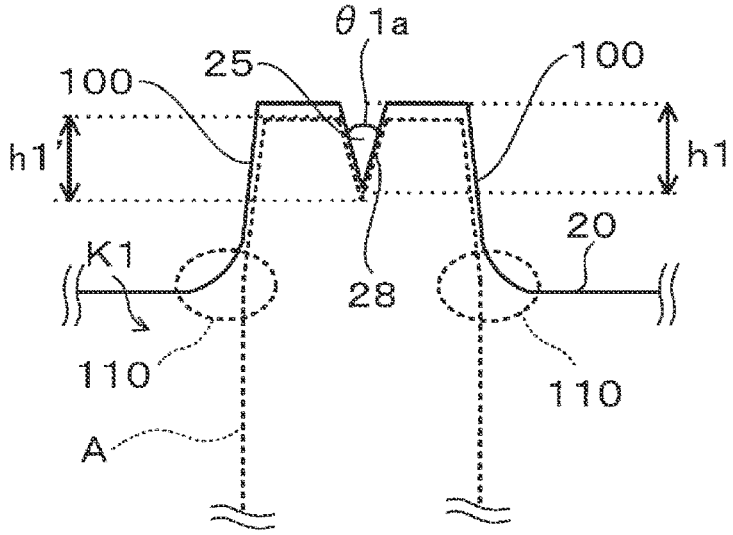
FIG. 11 is an explanatory diagram for a configuration in which relief portions are provided in the first caliber according to a modification example of the present invention.

FIG. 11 is an explanatory diagram for a configuration in which relief portions are provided in the first caliber K1 according to a modification example of the present invention. As illustrated in FIG. 11, in the first caliber K1 according to the present modification example, relief portions 110 extending in a direction of going away (being distanced) from the material to be rolled A are formed at the material-to-be-rolled entry side of the side-wall portions 100. The relief portions 110 are formed in all the side-wall portions 100 at four places of the first caliber K1, though not all of them are illustrated.

The relief portions 110 may be provided in any shapes that prevent occurrence of overfill of metal in the caliber as described above, and preferably have curved shapes with a curvature radius R of 400 mm or less, for example. As described above with reference to FIG. 10, the overfill 102 occurs because reduction applied to the material to be rolled A by the projection (wedge portion) 25 leads to bulging to the outer side, and metal of the material to be rolled A is pushed out from the caliber because of extremely strong restraint by the side-wall portions 100 of the first caliber K1. Moreover, in the first caliber K1, rolling that does not cause stretch in the longitudinal direction of the material to be rolled A is performed, and an area of reduction of a portion corresponding to a slab end portion of the material to be rolled A (a portion corresponding to within the range of the height h1 of the projection 25) in the projection 25 and the first caliber K1 is preferably designed to be equal to an area release by the relief portions 110. Note that the shapes of the relief portions 110 are not limited to curved shapes, and may be tapered shapes or the like, for example.

Providing the relief portions 110 in the first caliber K1 in this manner prevents occurrence of overfill of metal in the side-wall portions 100 in shaping, and thus can prevent occurrence of shape defects due to overfill in flanges of an H-shaped steel product that is finally shaped.

In addition, the above embodiment describes a step in which, in shaping of H-shaped steel using the second to fourth calibers K2 to K4, shaping is performed in a manner that splits are formed on slab end surfaces (upper and lower end portions of the material to be rolled A), and left and right flange-corresponding portions are bent outwardly together with the formation of the splits, as illustrated in FIGS. 3 to 5; however, an applicable range of the present invention is not limited to this. That is, the present invention is also applicable to conventional technologies in which splits are created on end surfaces of a material (slab end surfaces) and the end surfaces are subjected to edging, and the spread is utilized for rough rolling, as described in Patent Literatures 1 and 2. Also in this case, applying a wedge height configuration according to the invention of this application improves inductivity and material-passing property for a material to be rolled in the caliber, and enables an improvement in dimensional accuracy of a produced H-shaped steel product.

For example, in the above embodiment, description is given assuming that the four calibers of the first to fourth calibers K1 to K4 are engraved to perform shaping of the material to be rolled A, but the number of calibers for performing the rough rolling step is not limited to this. That is, the number of calibers engraved in the sizing mill 3 and the rough rolling mill 4 can be changed arbitrarily, and is changed as appropriate to the extent that the rough rolling step can be performed suitably.

The above embodiment describes that shaping of bending the flange-corresponding portions (later flange portions 80) is performed by using the third caliber K3 and the fourth caliber K4. This is because it is preferable to assign a plurality of calibers (the third caliber K3 and the fourth caliber K4 in the above embodiment) to bending shaping, because if bending shaping is performed with the bending angle (i.e., the wedge angle in each caliber) rapidly increased, friction force between the projections and the material to be rolled A is likely to cause a reduction in cross-sectional area, and bending power increases, which may impair uniformity in cross-sectional area between the four flange-corresponding portions (later flange portions 80). According to experimental results by the present inventors, it is preferable to perform bending shaping in two calibers of the third caliber K3 and the fourth caliber K4 described in the above embodiment.

EXAMPLES

As Examples of the present invention, H-shaped steel was shaped by the method described in the above embodiment by using a slab with a thickness of 300 mm and a width of 2300 mm as a material. In Comparative Example 1, the wedge height in the first caliber K1 was set to 80 mm, which is the same as a conventional wedge height, and in Example 1, the wedge height in the first caliber K1 was set to 160 mm, which is larger than a conventional wedge height. Then, for each of Example 1 and Comparative Example 1, a difference between thicknesses of left and right flange-corresponding portions (flange thicknesses) at the end of shaping using the third caliber K3 was measured as a flange center-portion thickness difference. Table 1 below shows a pass schedule; G1, G2, and G3 in the table indicate, respectively, the first caliber K1, the second caliber K2, and the third caliber K3.

TABLE 1

| Pass | G | Wedge tip width |
|---|---|---|
| Material | | 2,300.0 |
| 1 | 1 | 2,200.0 |
| 2 | 1 | 2,120.0 |
| 3 | 2 | 2,000.0 |
| 4 | 2 | 1,900.0 |
| 5 | 2 | 1,800.0 |
| 6 | 2 | 1,700.0 |
| 7 | 2 | 1,600.0 |
| 8 | 2 | 1,500.0 |
| 9 | 2 | 1,460.0 |
| 10 | 3 | 1,800.0 |
| 11 | 3 | 1,600.0 |
| 12 | 3 | 1,416.0 |

Figure 12:
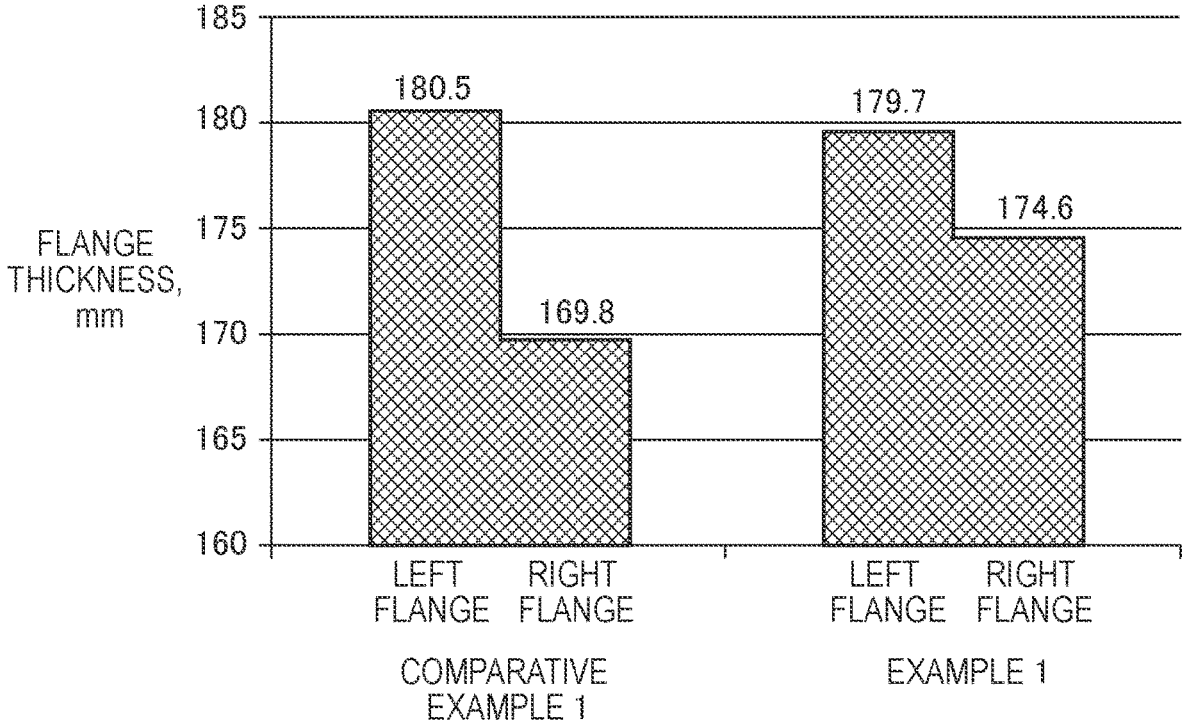
FIG. 12 is a graph showing measurement results of left and right flange thicknesses at the end of shaping using the third caliber for each of Comparative Example 1 and Example 1.

FIG. 12 is a graph showing measurement results of left and right flange thicknesses at the end of shaping using the third caliber K3 for each of Comparative Example 1 and Example 1. As shown in FIG. 12, a difference between the left and right flange thicknesses was 10.7 mm (=180.5 mm−169.8 mm) in Comparative Example 1, whereas a difference between the left and right flange thicknesses was 5.1 mm (=179.7 mm−174.6 mm) in Example 1. That is, in the method for shaping H-shaped steel according to the above embodiment, when the wedge height of the first caliber K1 was set to a height larger than a conventional height to fall within a suitable range, in shaping of the material to be rolled A using the third caliber K3, a difference in cross-sectional area between left and right flange-corresponding portions was able to be decreased, leading to a decrease in flange thickness variations. The decrease in left and right flange thickness variations improves dimensional accuracy of an H-shaped steel product that is shaped, as a matter of course.

INDUSTRIAL APPLICABILITY

The present invention can be applied to a method for producing H-shaped steel using a slab or the like having a rectangular cross-section as a material, for example.

The invention claimed is:

1. A method for producing H-shaped steel, the method comprising:

a rough rolling step of shaping a material to be rolled in one or a plurality of passes, the material to be rolled being a slab material having a width and a thickness, where a ratio of the width to the thickness is equal to or more than 6.0 and equal to or less than 7.7, the shaping of the material to be rolled performed by a rolling mill having a plurality of calibers engraved thereon to shape the material to be rolled, a number of the plurality of calibers being four or more, the plurality of calibers having a first caliber and a second caliber, each including a projection that splits vertically the material to be rolled in a width direction, the projection formed in the first caliber having a height of 100 mm or more, and the projections formed in the first caliber and the second caliber having a tip angle of 40° or less, respectively;

an intermediate rolling step of reverse rolling the material after the rough rolling step to obtain an intermediate material; and a finish rolling step of shaping the intermediate material to the H-shaped steel.

2. The method for producing H-shaped steel according to claim 1, wherein the slab material has a slab width of 1800 mm or more and a slab thickness of 300 mm or more at a start of shaping in the first caliber.

3. The method for producing H-shaped steel according to claim 1, wherein the slab material has a slab width of 1200 mm or more and a slab thickness of 250 mm or more at a start of shaping in the first caliber.

4. The method for producing H-shaped steel according to claim 1, wherein the tip angle of the projections formed in the first caliber and the second caliber is equal to or more than 25° and equal to or less than 35°, respectively.

5. The method for producing H-shaped steel according to claim 1, wherein;

in the second caliber and subsequent calibers among the plurality of calibers, reduction is performed in a state where end surfaces of the material to be rolled are in contact with caliber peripheral surfaces in the rough rolling step; and in a third caliber and subsequent calibers among the plurality of calibers, in addition to the reduction, a step of sequentially bending divided parts formed by the splits is performed.

6. The method for producing H-shaped steel according to claim 1, wherein the first caliber is provided with relief portions extending in a direction of being distanced from the material to be rolled at a material-to-be-rolled entry side of a side-wall portion of the first caliber that is adjacent to a side surface of the material to be rolled while the rough rolling step is being performed.

7. The method for producing H-shaped steel according to claim 6, wherein the relief portions have a curved shape in which an inner surface of the relief portions, which is facing with the material to be rolled, is curved away from the material to be rolled, and a curvature radius R of the curved shape is 400 mm or less.

8. The method for producing H-shaped steel according to claim 1, wherein;

the tip angle of the projections formed in the first caliber and the second caliber is equal to or more than 25° and equal to or less than 35°, respectively;

in the second caliber and subsequent calibers among the plurality of calibers, reduction is performed in a state where end surfaces of the material to be rolled are in contact with caliber peripheral surfaces in the rough rolling step; and in a third caliber and subsequent calibers among the plurality of calibers, in addition to the reduction, a step of sequentially bending divided parts formed by the splits is performed.

9. The method for producing H-shaped steel according to claim 1, wherein the tip angle of the projections formed in the first caliber and the second caliber is equal to or more than 25° and equal to or less than 35°, respectively, and the first caliber is provided with relief portions extending in a direction of being distanced from the material to be rolled is formed at a material-to-be-rolled entry side of a side-wall portion of the first caliber that is adjacent to a side surface of the material to be rolled while the rough rolling step is being performed.

10. The method for producing H-shaped steel according to claim 1, wherein;

the tip angle of the projections formed in the first caliber and the second caliber is equal to or more than 25° and equal to or less than 35°, respectively;

the first caliber is provided with relief portions extending in a direction of being distanced from the material to be rolled at a material-to-be-rolled entry side of a side-wall portion of the first caliber that is adjacent to a side surface of the material to be rolled while the rough rolling step is being performed;

the relief portions have a curved shape in which an inner surface of the relief portions, which is facing with the material to be rolled, is curved away from the material to be rolled; and a curvature radius R of the curved shape is 400 mm or less.

* * * * *